US008191939B2

(12) United States Patent
Lin

(10) Patent No.: US 8,191,939 B2
(45) Date of Patent: Jun. 5, 2012

(54) FIRE BOLT ASSEMBLY FOR DOOR

(75) Inventor: Hsi-Ting Lin, Guiren Township, Tainan County (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 235 days.

(21) Appl. No.: 12/710,404

(22) Filed: Feb. 23, 2010

(65) Prior Publication Data

US 2011/0204658 A1 Aug. 25, 2011

(51) Int. Cl.
*E05B 65/10* (2006.01)
*E05C 1/08* (2006.01)

(52) U.S. Cl. ..... 292/92; 292/1; 292/137; 292/163; 292/DIG. 65; 292/DIG. 66

(58) Field of Classification Search ..... 292/1, 1.5, 292/80, 92, 137, 150, 163, 169, DIG. 38, 292/DIG. 65, DIG. 66
See application file for complete search history.

(56) References Cited

U.S. PATENT DOCUMENTS

| | | | | | |
|---|---|---|---|---|---|
| 3,018,535 | A * | 1/1962 | Griffin | 24/625 |
| 3,325,941 | A * | 6/1967 | Prucha | 49/7 |
| 4,183,565 | A * | 1/1980 | Allemann | 292/163 |
| 4,303,286 | A * | 12/1981 | McClellan | 312/409 |
| 4,363,420 | A * | 12/1982 | Andrews | 220/787 |
| 4,504,009 | A * | 3/1985 | Boik et al. | 229/5.5 |
| 4,714,285 | A * | 12/1987 | Langham | 292/163 |
| 4,767,140 | A * | 8/1988 | Lin | 292/337 |
| 5,121,950 | A * | 6/1992 | Davidian | 292/164 |
| 5,380,053 | A * | 1/1995 | Saino | 292/144 |
| 5,427,420 | A * | 6/1995 | Moore | 292/169 |
| 5,456,503 | A * | 10/1995 | Russell, IV | 292/1.5 |
| 5,690,371 | A * | 11/1997 | Turnbull | 292/163 |
| 5,782,509 | A * | 7/1998 | Uyeda | 292/92 |
| 6,708,979 | B2 * | 3/2004 | Stratman et al. | 277/316 |
| 7,347,655 | B2 * | 3/2008 | Nagasawa et al. | 411/508 |
| 7,488,012 | B2 * | 2/2009 | Eller et al. | 292/164 |
| D617,178 | S * | 6/2010 | Sakai | D8/382 |
| 2005/0284030 | A1 * | 12/2005 | Autovino et al. | 52/1 |

* cited by examiner

*Primary Examiner* — Carlos Lugo
(74) *Attorney, Agent, or Firm* — Alan Kamrath; Kamrath IP Lawfirm, PA

(57) ABSTRACT

A fire bolt assembly (10) includes a receiving tube (20) mounted in a door (106). A mounting member (32) is mounted to the receiving tube (20) and includes two coupling faces (56). A positioning bolt (90) is received in the receiving tube (20) and includes a front end (92). A spring (100) is mounted in the receiving tube (20) for biasing the front end (92) of the positioning bolt (90) out of the receiving tube (20). A stop member (58) includes two legs (66) respectively engaged with the coupling faces (56) of the mounting member (32) to hold the positioning bolt (90) in the receiving tube (20). The front end (92) of the positioning bolt (90) is moved out of the receiving tube (20) to engage with a coupling hole (116) in another door (112) or a door frame when the stop member (58) melts due to the heat of the fire, locking the door (106) in place during the fire.

8 Claims, 5 Drawing Sheets

FIRE BOLT ASSEMBLY FOR DOOR

BACKGROUND OF THE INVENTION

The present invention relates to a fire bolt assembly and, more particularly, to a fire bolt assembly preventing opening of a door when exposed to a fire.

It is known to mount a fire bolt assembly in a door (often referred to as a fireproof door) for automatically locking the door in a closed state when a fire occurs, preventing flowing of smoke and fire from one side of the door to the other side. In an approach, a fire bolt assembly includes a receiving tube mounted in a door, a positioning bolt received in the receiving tube and biased by a spring received in the receiving tube, and a stop member secured in an opening of the receiving tube for maintaining the positioning bolt in the receiving tube. The stop member is made of plastic material having a melting point of about 250-350° C., which is lower than those of the receiving tube, the positioning bolt, and the spring. The positioning bolt is moved out of the receiving tube and engaged with an engaging hole in another door or a door frame when the stop member melts due to the heat of the fire, allowing locking of the door in the event of a fire. However, the stop member has a skirt that is completely received in the receiving tube so that a considerable portion of the melted stop member may remain in the receiving tube and hinder the positioning bolt from moving out of the receiving tube after the stop member has melted, resulting in failure of the locking function of the positioning bolt.

Thus, a need exists for a fire bolt assembly for a door which is capable of preventing the door from being opened when exposed to a fire while allowing easy assembly of the fire bolt assembly.

BRIEF SUMMARY OF THE INVENTION

The present invention solves this need and other problems in the field of fire bolt assemblies for locking doors during fires by providing, in a preferred form, a fire bolt assembly including a receiving tube adapted to be mounted in a door. The receiving tube includes front and rear ends spaced along a first axis. The receiving tube further includes a receiving space extending along the first axis and having an opening in the front end of the receiving tube. A mounting member includes a mounting plate adapted to be fixed on an end face of the door. The mounting plate includes first and second faces spaced along the first axis. The mounting member further includes a sleeve protruding from the second face and extending away from the first face of the mounting plate along the first axis. The mounting member further includes an axial hole extending from the first face of the mounting plate through the sleeve along the first axis. The sleeve of the mounting member extends through the front end of the receiving tube and is received in the receiving space of the receiving tube. The sleeve of the mounting member includes first and second coupling faces spaced along a second axis perpendicular to the first axis. Each of the first and second coupling faces is spaced from the second face of the mounting plate along the first axis. A stop member is mounted in the axial hole of the mounting member and includes a stop plate having front and rear surfaces spaced along the first axis. The stop member further includes first and second legs spaced along the second axis and each protruding from the rear surface and extending away from the front surface of the stop plate along the first axis. Each leg extends into the axial hole of the mounting member. Each leg includes a connecting end interconnected to the rear surface of the stop plate and a free end distant to the rear surface of the stop plate. The free end is spaced from the connecting end along the first axis. Each leg further includes outer and inner side faces spaced along the second axis. The inner side faces of the first and second legs face each other. A spacing perpendicular to the first axis between the inner side faces of the connecting ends of the first and second legs is smaller than that between the inner side faces of the free ends of the first and second legs. A hook is formed on the outer side face of the free end of each of the first and second legs and includes an engaging face extending in a third axis perpendicular to the first and second axes. The engaging face of the hook of each leg engages with one of the first and second coupling faces of the sleeve of the mounting member. The outer side face of the connecting end of each of the first and second legs is spaced from the sleeve of the mounting member. A positioning bolt is received in the receiving space of the receiving tube. The positioning bolt includes front and rear ends spaced along the first axis. A spring is received in the receiving space of the receiving tube and compressed between the rear end of the positioning bolt and the rear end of the receiving tube. The front end of the positioning bolt is biased by the spring and presses against the inner side faces of the first and second legs of the stop member. The stop member is made of material having a melting point lower than those of the mounting member, the positioning bolt, and the receiving tube. The stop member holds the positioning bolt in the receiving space of the receiving tube. The spring biases the front end of the positioning bolt out of the front end of the receiving tube when the stop member melts.

In the most preferred form, the front end of the positioning bolt is spaced from the rear surface of the stop member along the first axis. The front end of the positioning bolt includes an abutting periphery tapering away from the rear end of the positioning bolt. The sleeve of the mounting member includes inner and outer peripheries spaced in a radial direction perpendicular to the first axis. The sleeve of the mounting member further includes first and second radial holes extending in the radial direction from the outer periphery through the inner periphery of the sleeve. Each radial hole includes a side wall forming one of the first and second coupling faces of the sleeve. The hook of each leg of the stop member is engaged in one of the radial holes with the engaging face of the hook of each leg engaged with one of the side walls of the radial holes.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
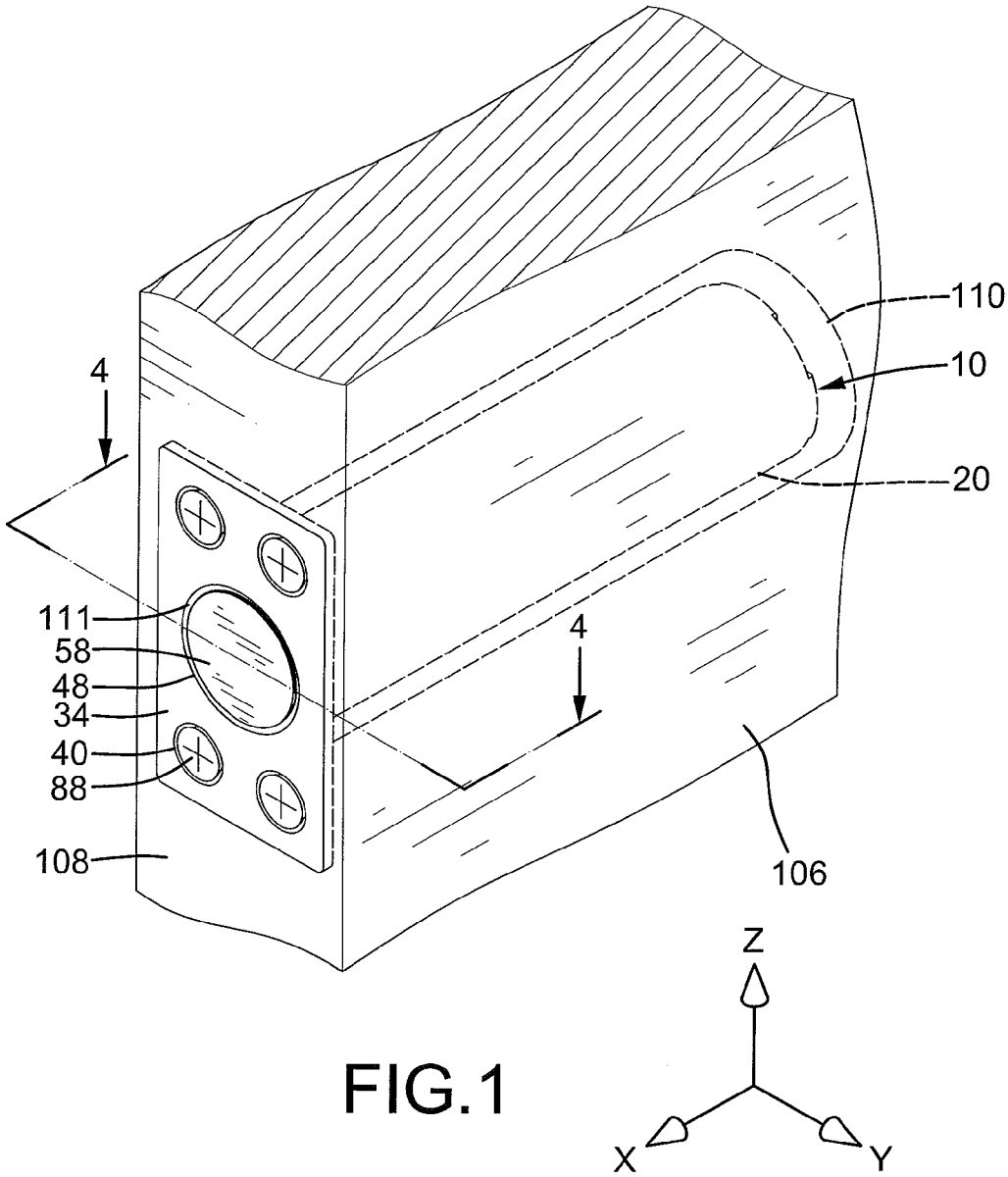
FIG. 1 shows a schematically perspective view of a fire bolt assembly according to the preferred teachings of the present invention and a door to which the fire bolt assembly is mounted.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "upper", "lower", "inner", "outer", "front", "rear", "side", "end", "portion", "top", "bottom", "radial", "vertical", "spacing", "width", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A fire bolt assembly according to the preferred teachings of the present invention is shown in the drawings and generally designated 10. According to the preferred form shown, fire bolt assembly 10 is mounted in a door 106. Door 106 includes an end face 108 extending in a vertical direction and a mounting hole 110 extending along a first axis X perpendicular to the vertical direction and having an opening 111 in end face 108. Door 106 and another door 112 are respectively and pivotably mounted to opposite sides of a door frame. Door 112 includes an end face 114 extending in the vertical direction and a coupling hole 116 formed in end face 114 and aligned with mounting hole 110 of door 106 when doors 106 and 112 are in a closed state. It can be appreciated that door 112 can be replaced with a door frame having coupling hole 116 formed in end face 114 thereof.

According to the preferred form shown, fire bolt assembly 10 includes a receiving tube 20 made of metal and having circular cross sections. Receiving tube 20 includes front and rear ends 22 and 24 spaced along the first axis X. Receiving tube 20 further includes a receiving space 28 extending along the first axis X and having an opening 30 in front end 22. Four tabs 26 protrude outward from rear end 24 of receiving tube 20 along the first axis X and are spaced in a circumferential direction of rear end 24 of receiving tube 20. Receiving tube 20 is received in mounting hole 110 of door 106 with front end 24 of receiving tube 20 adjacent opening 111 of mounting hole 110.

Figure 4A:
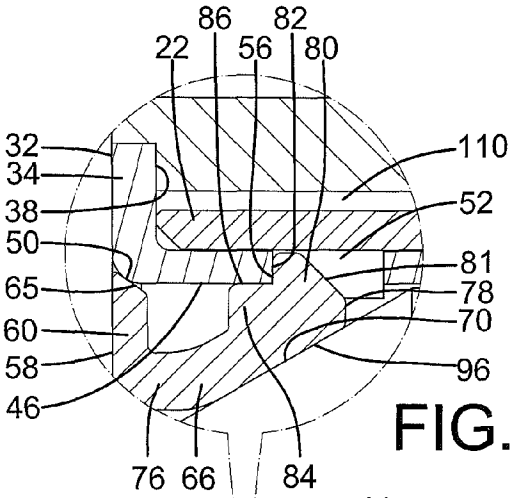
FIG. 4*a* shows an enlarged view of a circled portion of FIG. 4.

According to the preferred form shown, fire bolt assembly 10 further includes a mounting member 32. Mounting member 32 includes a mounting plate 34 having rectangular cross sections and having first and second faces 36 and 38 spaced along the first axis X. Mounting member 32 further includes a sleeve 42 protruding from second face 38 and extending away from first face 36 of mounting plate 34 along the first axis X. Sleeve 42 includes a front end 43 interconnected to second face 38 of mounting plate 34 and a rear end 44 spaced from front end 43 along the first axis X and distant to second face 38 of mounting plate 34. An axial hole 46 extends from first face 36 of mounting plate 34 through sleeve 42 along the first axis X and includes an opening 48 in first face 36 of mounting plate 34. Opening 48 includes a conical inner periphery 50 tapering from first face 36 towards second face 38 of mounting plate 34. Sleeve 42 of mounting member 32 further includes inner and outer peripheries spaced in a radial direction perpendicular to the first axis X. Sleeve 42 of mounting member 32 further includes first and second engaging portions 52 spaced along a second axis Y perpendicular to the first axis X. In the preferred form shown, each engaging portion 52 is a radial hole extending in the radial direction from the outer periphery through the inner periphery of sleeve 42. Each engaging portion 52 includes upper and lower end faces 54 and 55 spaced along a third axis Z perpendicular to the first and second axes X and Y. Each engaging portion 52 further includes a coupling face 56 formed by a side wall interconnected between upper and lower end faces 54 and 55 and extending along the third axis Z. Coupling faces 56 of first and second engaging portions 52 are spaced from second face 38 of mounting plate 34 along the first axis X (FIG. 4*a*). Furthermore, sleeve 42 of mounting member 32 extends through front end 22 of receiving tube 20 and is secured in receiving space 28 of receiving tube 20 by welding such that front end 22 of receiving tube 20 abuts second face 38 of mounting plate 34. Four spaced fixing holes 40 are provided in mounting plate 34 and extend from first face 36 through second face 38 of mounting plate 34. Fasteners 88 extend through fixing holes 40 of mounting plate 34 into door 106 to secure mounting member 32 to door 106 with mounting plate 34 abutting end face 108 of door 106 (FIG. 1).

According to the preferred form shown, fire bolt assembly 10 further includes a stop member 58 made of plastic material. Stop member 58 includes a stop plate 60 having front and rear surfaces 62 and 64 spaced along the first axis X. Stop plate 60 of stop member 58 further includes a peripheral wall 65 tapering from front surface 62 towards rear surface 64 and having a conicity equal to that of inner periphery 50 of opening 48 of mounting plate 34. Stop member 58 is mounted in axial hole 46 of mounting member 32 with peripheral wall 65 of stop plate 60 abutting inner periphery 50 of opening 48 of mounting member 32. Stop member 58 further includes first and second legs 66 spaced along the second axis Y and each protruding from rear surface 64 and extending away from front surface 62 of stop plate 60 along the first axis X. Each leg 66 includes a connecting end 76 interconnected to rear surface 64 of stop plate 60 and a free end 78 spaced from connecting end 76 along the first axis X and distant to rear surface 64 of stop plate 60. Each leg 66 further includes outer and inner side faces 68 and 70 spaced along the second axis Y. Inner side faces 70 of legs 66 face each other. Outer side face 68 of connecting end 76 of each leg 66 is spaced from sleeve 42 of mounting member 32. A spacing perpendicular to the first axis X between inner side faces 70 of connecting ends 76 of legs 66 is smaller than that between inner side faces 70 of free ends 78 of legs 66. A width perpendicular to the first axis X between outer side faces 68 of free ends 78 of legs 66 is larger than a diameter of axial hole 46 of mounting member 32. Each leg 66 further includes upper and lower faces 72 and 74 spaced along the third axis Z. A hook 80 is formed on outer side face 68 of each leg 66 and includes an inclined face 81 adjacent to free end 78 of each leg 66. Hook 80 further includes an engaging face 82 facing rear surface 64 of stop plate 60 and extending along the third axis Z. A projection 84 is formed on outer side face 68 of each leg 66 and adjacent to a side of hook 80. Projection 84 of each leg 66 includes a stop face 86 extending along the third axis Z. In installation of stop member 58 into axial hole 46 of mounting member 32, legs 66 of stop member 58 are extended into axial hole 46 of mounting member 32 with free ends 78 of legs 66 pressed radially inward. Free ends 78 of legs 66 deform so that inclined face 81 of each leg 66 slides along inner periphery 50 of opening 48 of mounting member 32 to guide legs 66 of stop member 58 into axial hole 46 of mounting member 32. When hooks 80 of stop member 58 are respectively aligned with engaging portions 52 of sleeve 42 of mounting member 32, each hook 80 of stop member 58 is engaged in one of engaging portions 52 of sleeve 42 by the resiliency of legs 66 with engaging face 82 of each hook 80 engaged with one of coupling faces 56 of engaging portions 52, preventing movement of stop member 58 relative to mounting member 32. Furthermore, upper and lower faces 72 and 74 of each leg 66 respectively abut upper and lower end faces 54 and 55 of each engaging portion 52, and stop face 86 of projection 84 of each leg 66 abuts the inner periphery of axial hole 46, further preventing movement of stop member 58 relative to mounting member 32.

Figure 2:
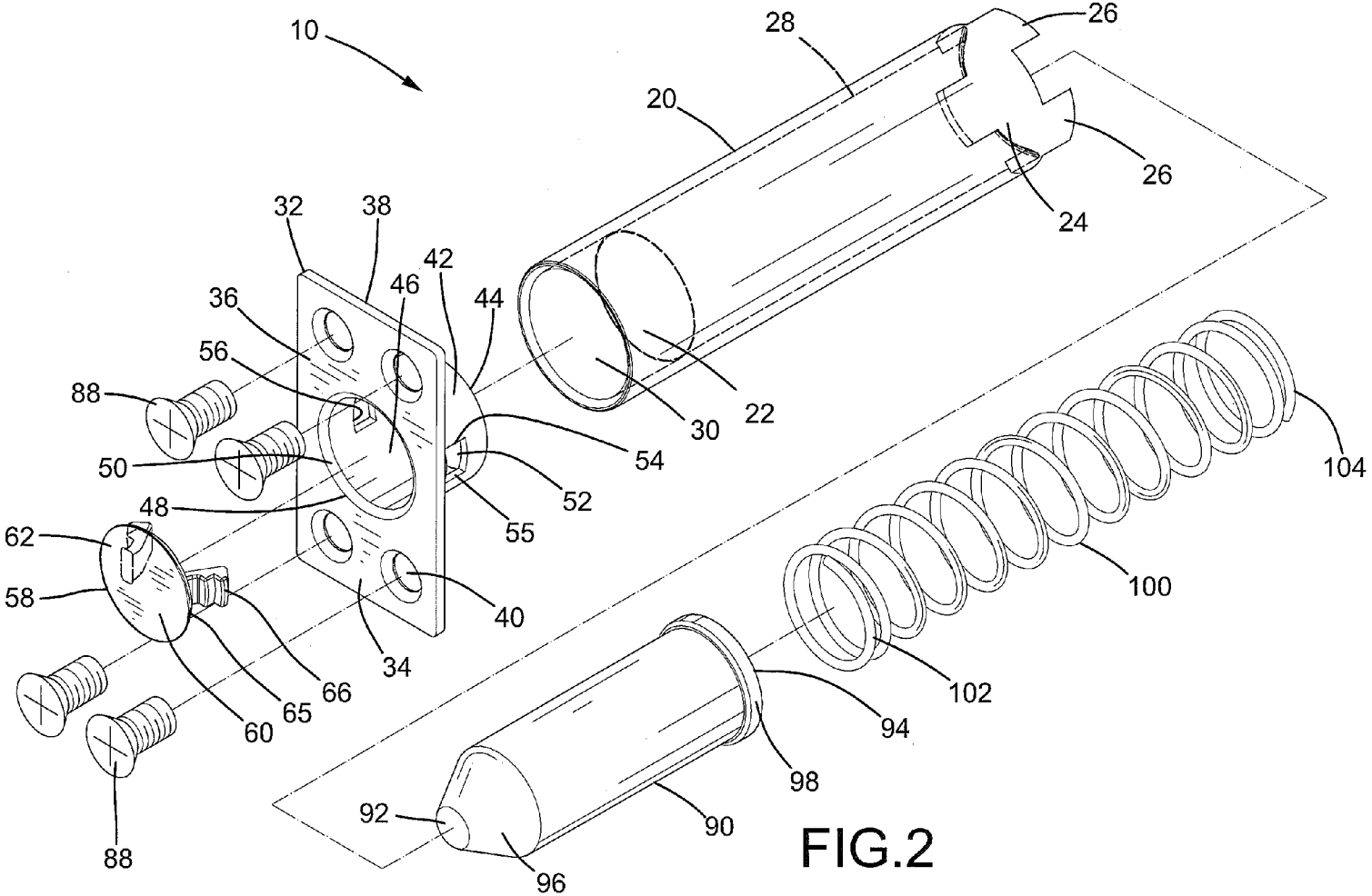
FIG. 2 shows an exploded, perspective view of the fire bolt assembly of FIG. 1.
Figure 3:
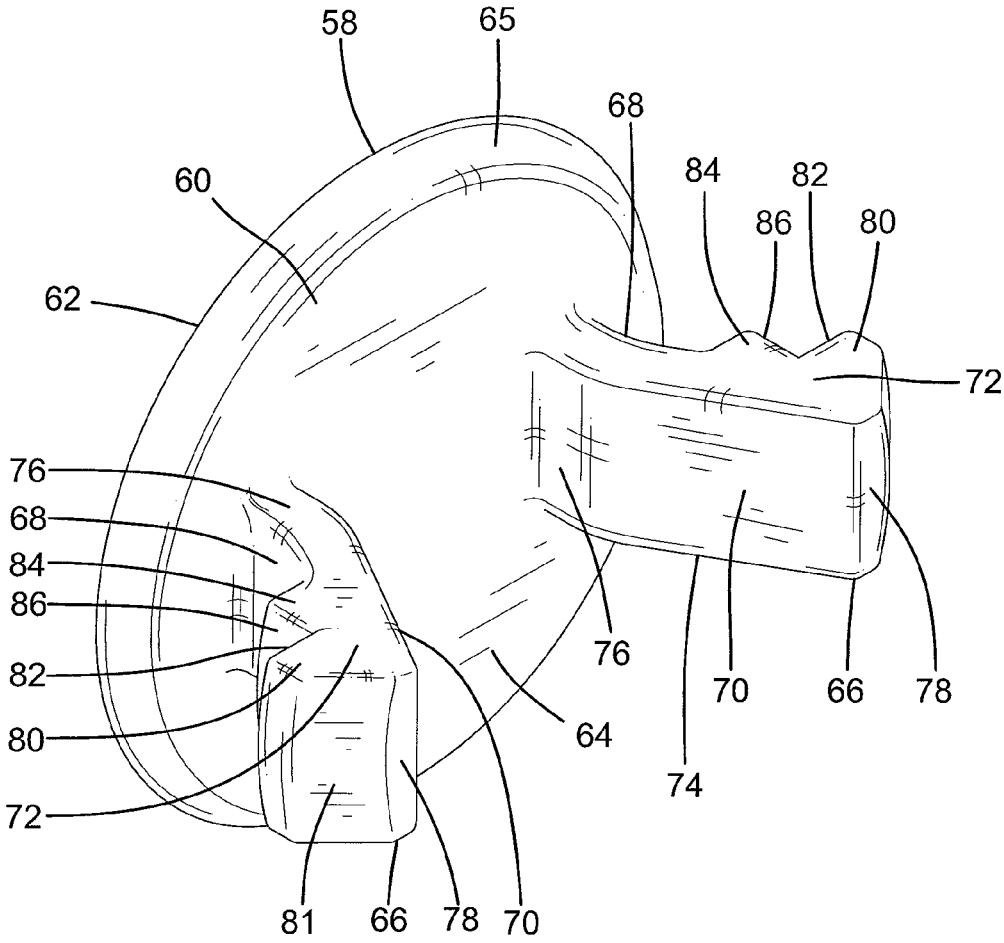
FIG. 3 shows a perspective view of a stop member of the fire bolt assembly of FIG. 1.

According to the preferred form shown, fire bolt assembly 10 further includes a positioning bolt 90 and a spring 100 both received in receiving space 28 of receiving tube 20. Positioning bolt 90 includes front and rear ends 92 and 94 spaced along the first axis X. Front end 92 of positioning bolt 90 includes an abutting periphery 96 tapering away from rear end 94 of positioning bolt 90. Front end 92 of positioning bolt 90 is spaced from rear surface 64 of stop plate 60 along the first axis X. Positioning bolt 90 includes a flange 98 on rear end 94 thereof. Flange 98 has a diameter perpendicular to the first axis X greater than those of positioning bolt 90 and axial hole 46 of mounting member 32. Spring 100 is compressed between rear end 94 of positioning bolt 90 and rear end 24 of receiving tube 20. Spring 100 includes a first end 102 abutting against rear end 94 of positioning bolt 90 and a second end 104 abutting against rear end 24 of receiving tube 20 so that front end 92 of positioning bolt 90 is biased by spring 100 and presses against inner side faces 70 of first and second legs 66 of stop member 58. When positioning bolt 90 and spring 100 are received in receiving space 28 of receiving tube 20, tabs 26 of receiving tube 20 are bent to press against second end 104 of spring 100, retaining positioning bolt 90 and spring 100 in receiving space 28 of receiving tube 20 (see FIGS. 2 and 4).

Figure 4:
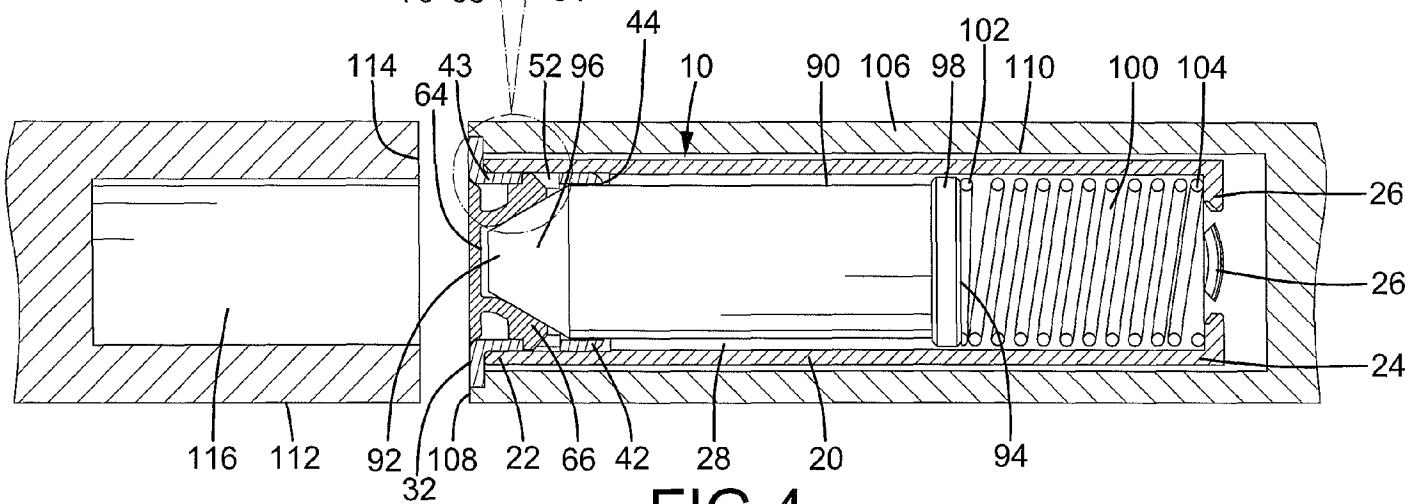
FIG. 4 shows a cross sectional view of the fire bolt assembly and the door of FIG. 1 according to section line 4-4 of FIG. 1, with another door shown aligned with the door.
Figure 5:
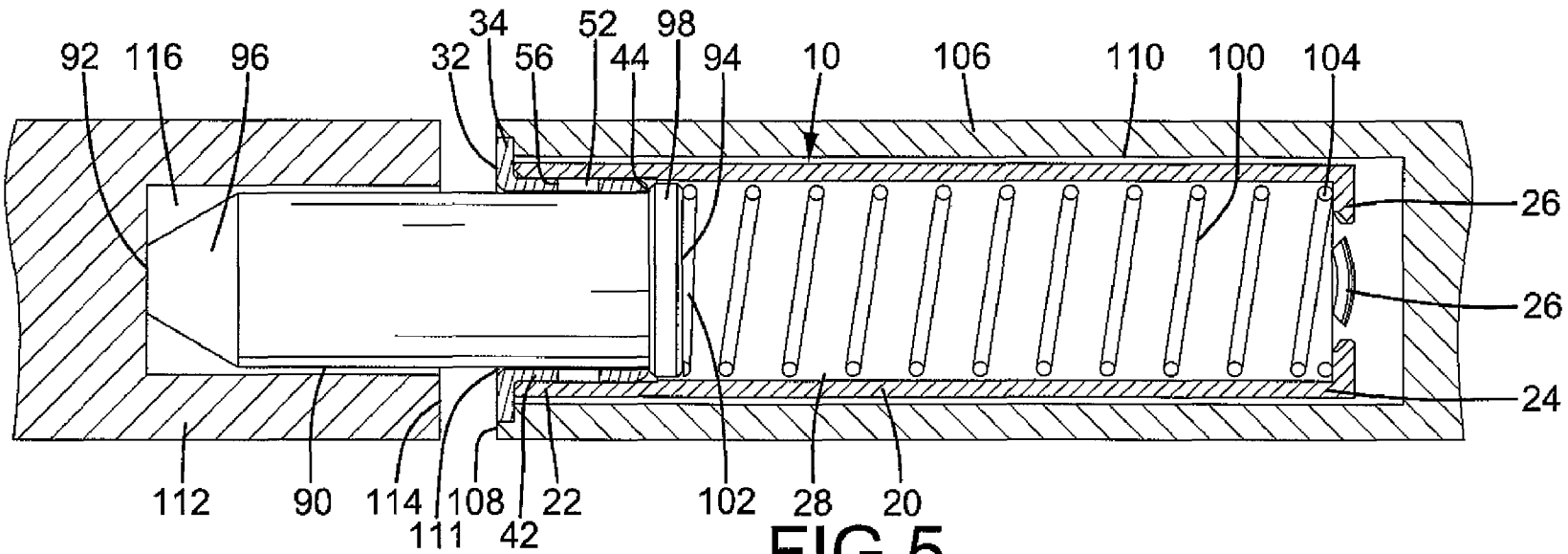
FIG. 5 shows a cross sectional view similar to FIG. 4, with a positioning bolt of the fire bolt assembly of FIG. 4 moved into a coupling hole in the other door after the stop member melts.

Fire bolt assembly 10 according to the preferred teachings of the present invention provides fire-resistant functions. Specifically, stop member 58 retains positioning bolt 90 in receiving tube 20 when fire bolt assembly 10 is in normal situations (FIG. 4). On the other hand, when doors 106 and 112 and fire bolt assembly 10 are exposed to a fire and when stop member 58 melts by the heat of the fire, front end 92 of positioning bolt 90 is biased by spring 100 and moved out of receiving tube 20 to engage with coupling hole 116 in door 112, locking doors 106 and 112 and preventing doors 106 and 112 from undesired opening. Note that flange 98 of positioning bolt 90 abuts against rear end 44 of sleeve 42 when front end 92 of positioning bolt 90 extends out of front end 22 of receiving tube 20 while stop member 58 melts.

Fire bolt assembly 10 according to the preferred teachings of the present invention reduces failure of the locking function of the positioning bolt 90. Specifically, only two legs 66 of stop member 58 are received in axial hole 46 of mounting member 32 so that less material of the melted stop member 58 remains in the mounting member 32. Thus, the positioning bolt 90 will not be blocked by the melted stop member 58 and can reliably move out of the receiving tube 20 after the stop member 58 has melted.

Now that the basic teachings of the present invention have been explained, many extensions and variations will be obvious to one having ordinary skill in the art. For example, positioning bolt 90 does not have to include flange 98 in a case that the length of positioning bolt 90 along the first axis X is larger than that of coupling hole 116 in door 112. Furthermore, coupling face 56 can be in the form of a protrusion instead of a radial hole. Although the second axis Y is perpendicular to the vertical direction and the third axis Z is parallel to the vertical direction in the preferred form shown, it can be appreciated that the second axis Y can be parallel to the vertical direction and the third axis Z can be perpendicular to the vertical direction.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A fire bolt assembly for a door comprising, in combination:

a receiving tube adapted to be mounted in a door, with the receiving tube including front and rear ends spaced along a first axis with the receiving tube further including a receiving space extending along the first axis and having an opening in the front end of the receiving tube;

a mounting member including a mounting plate adapted to be fixed on an end face of the door, with the mounting plate having first and second faces spaced along the first axis, with the mounting member further including a sleeve protruding from the second face and extending away from the first face of the mounting plate along the first axis, with the mounting member further including an axial hole extending from the first face of the mounting plate through the sleeve along the first axis, with the sleeve of the mounting member extending through the front end of the receiving tube and received in the receiving space of the receiving tube, with the sleeve of the mounting member including first and second coupling faces spaced along a second axis perpendicular to the first axis, with each of the first and second coupling faces spaced from the second face of the mounting plate along the first axis;

a stop member mounted in the axial hole of the mounting member and including a stop plate having front and rear surfaces spaced along the first axis, with the stop member further including first and second legs spaced along the second axis and each protruding from the rear surface and extending away from the front surface of the stop plate along the first axis, with each of the first and second legs extending into the axial hole of the mounting member, with each of the first and second legs including a connecting end interconnected to the rear surface of the stop plate and a free end distant to the rear surface of the stop plate, with the free end spaced from the connecting end along the first axis, with each of the first and second legs further including outer and inner side faces spaced along the second axis, with the inner side faces of the first and second legs facing each other, with a spacing perpendicular to the first axis between the inner side faces of the connecting ends of the first and second legs being smaller than that between the inner side faces of the free ends of the first and second legs, with a hook formed on the outer side face of the free end of each of the first and second legs and including an engaging face extending in a third axis perpendicular to the first and second axes, with the engaging face of each of the hooks engaging with one of the first and second coupling faces of the sleeve of the mounting member, with the outer side face of the connecting end of each of the first and second legs spaced from the sleeve of the mounting member;

a positioning bolt received in the receiving space of the receiving tube, with the positioning bolt including front and rear ends spaced along the first axis; and a spring received in the receiving space of the receiving tube, with the spring compressed between the rear end of the positioning bolt and the rear end of the receiving tube, with the front end of the positioning bolt being biased by the spring and pressing against the inner side faces of the first and second legs of the stop member;

with the stop member made of material having a melting point lower than those of the mounting member, the positioning bolt, and the receiving tube, with the stop member holding the positioning bolt in the receiving space of the receiving tube, with the spring biasing the front end of the positioning bolt out of the front end of the receiving tube when the stop member melts, with the front end of the positioning bolt including an abutting periphery tapering away from rear end of the positioning bolt, with the abutting periphery of the positioning bolt pressing against the inner side faces of the first and second legs of the stop member under the bias of the spring, accommodating the positioning bolt in place and preventing the stop member from disengaging from the receiving tube, with the front end of the positioning bolt spaced from the rear surface of the stop plate along the first axis.

2. The fire bolt assembly as claimed in claim 1, with the sleeve of the mounting member including inner and outer peripheries spaced in a radial direction perpendicular to the first axis, with the sleeve of the mounting member further including first and second radial holes extending in the radial direction from the outer periphery through the inner periphery of the sleeve, with each of the first and second radial holes including a side wall forming one of the first and second coupling faces of the sleeve, and with each of the hooks of the stop member engaged in one of the first and second radial holes, with the engaging face of each of the hooks engaged with one of the side walls of the first and second radial holes.

3. The fire bolt assembly as claimed in claim 2, with the axial hole of the mounting member including an opening in the first face of the mounting plate, with the opening including a conical inner periphery tapering from the first face towards the second face of the mounting plate, with the stop plate of the stop member including a peripheral wall tapering from the front surface towards the rear surface and having a conicity equal to that of the inner periphery of the opening, and with the peripheral wall of the stop plate abutting the inner periphery of the opening of the mounting member.

4. The fire bolt assembly as claimed in claim 3, with each of the first and second legs including a projection formed on the outer side face thereof and adjacent to a side of the hook, with the projection of each of the first and second legs including a stop face extending along the third axis, with the stop face abutting an inner periphery of the axial hole when the front end of the positioning bolt presses against the inner side faces of the first and second legs of the stop member.

5. The fire bolt assembly as claimed in claim 4, with the positioning bolt including a flange on the rear end of the positioning bolt, with the flange having a diameter perpendicular to the first axis greater than that of the positioning bolt, with the sleeve further including a front end interconnected to the second face of the mounting plate and a rear end distant to the second face of the mounting plate, with the rear end of the sleeve spaced from the front end of the sleeve along the first axis, with the diameter of the flange being greater than that of the axial hole, and with the flange abutting against the rear end of the sleeve when the front end of the positioning bolt extends out of the front end of the receiving tube while the stop member melts.

6. The fire bolt assembly as claimed in claim 1, with the axial hole of the mounting member including an opening in the first face of the mounting plate, with the opening including a conical inner periphery tapering from the first face towards the second face of the mounting plate, with the stop plate of the stop member including a peripheral wall tapering from the front surface towards the rear surface and having a conicity equal to that of the inner periphery of the opening, and with the peripheral wall of the stop plate abutting the inner periphery of the opening of the mounting member.

7. The fire bolt assembly as claimed in claim 6, with each of the first and second legs including a projection formed on the outer side face thereof and adjacent to a side of the hook, with the projection of each of the first and second legs including a stop face extending along the third axis, with the stop face abutting an inner periphery of the axial hole when the front end of the positioning bolt presses against the inner side faces of the first and second legs of the stop member.

8. The fire bolt assembly as claimed in claim 7, with the positioning bolt including a flange on the rear end of the positioning bolt, with the flange having a diameter perpendicular to the first axis greater than that of the positioning bolt, with the sleeve further including a front end interconnected to the second face of the mounting plate and a rear end distant to the second face of the mounting plate, with the rear end of the sleeve spaced from the front end of the sleeve along the first axis, with the diameter of the flange being greater than that of the axial hole, and with the flange abutting against the rear end of the sleeve when the front end of the positioning bolt extends out of the front end of the receiving tube while the stop member melts.

* * * * *